US007491917B2

(12) United States Patent
Ueno

(10) Patent No.: US 7,491,917 B2
(45) Date of Patent: Feb. 17, 2009

(54) FUSER AND IMAGE FORMING DEVICE

(75) Inventor: Satoshi Ueno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 243 days.

(21) Appl. No.: 11/422,227

(22) Filed: Jun. 5, 2006

(65) Prior Publication Data

US 2006/0289419 A1 Dec. 28, 2006

(30) Foreign Application Priority Data

Jun. 23, 2005 (JP) ..... 2005-183623

(51) Int. Cl.
*H05B 6/14* (2006.01)
*G03G 15/20* (2006.01)

(52) U.S. Cl. ..... 219/619; 399/67; 399/328; 219/216

(58) Field of Classification Search ..... 219/619, 219/618, 469, 470, 471, 600; 399/67, 68, 399/69, 70, 328, 329, 330, 331, 332, 333, 399/334, 335, 336, 337, 338
See application file for complete search history.

(56) References Cited

U.S. PATENT DOCUMENTS 5,486,903 A * 1/1996 Kanno et al. ..... 399/45
5,899,599 A * 5/1999 Kato ..... 399/69
6,552,304 B1 * 4/2003 Hirose et al. ..... 219/216
6,804,488 B2 * 10/2004 Matsumoto ..... 399/327
7,228,097 B2 * 6/2007 Matsumoto ..... 399/327
7,266,336 B2 * 9/2007 Ueno et al. ..... 399/329
2003/0210936 A1 * 11/2003 Matsumoto ..... 399/327
2005/0042003 A1 * 2/2005 Matsumoto ..... 399/327
2005/0191098 A1 9/2005 Ueno et al.
2006/0029411 A1 2/2006 Ishii et al.

FOREIGN PATENT DOCUMENTS

JP 10-161445 6/1998
JP 2000-198568 7/2000
JP 2001-13805 1/2001
JP 2001-188430 7/2001
JP 2002-83676 3/2002
JP 2002-132078 5/2002
JP 2005-70376 3/2005

* cited by examiner

*Primary Examiner*—Daniel L Robinson
(74) *Attorney, Agent, or Firm*—Oblon, Spivak, McClelland, Maier & Neustadt, P.C.

(57) ABSTRACT

A fuser includes a magnetic flux generation unit to generate a magnetic flux, a heating member which is heated by electromagnetic induction of the magnetic flux, a fuser member to contact the heating member and heat a toner image so as to fuse the toner image onto a recording medium, a detection unit to directly or indirectly detect a contacting state of the fuser member at an edge in a width direction of the fuser member with the heating member, and a magnetic flux adjusting member to reduce the magnetic flux acting upon an end in the width direction of the heating member in accordance with a detection result of the detection unit.

18 Claims, 7 Drawing Sheets

FUSER AND IMAGE FORMING DEVICE

BACKGROUND OF THE INVENTION

1. Field of the Invention

The present invention generally relates to an image forming device using an electrophotographic system such as a copier, a printer, a facsimile, or a multifunction machine thereof, and a fuser arranged therein, and more specifically, to a fuser and an image forming device in which a magnetic induction heating system is used.

2. Description of the Related Art

Conventionally, an image forming device such as a copier, a printer, and the like is well known in which a fuser of the electromagnetic induction heating system is used for the purpose of reducing the time necessary for starting the device so as to save energy. Such a device is disclosed in Japanese Laid-Open Patent Application Publication No. 2005-70376.

In Japanese Laid-Open Patent Application Publication No. 2005-70376, the fuser of the electromagnetic induction heating system comprises a heating roller as a heating member, auxiliary fuser roller (fuser roller), a fuser belt as a fuser member stretched between the heating roller and the auxiliary fuser roller, induction heating unit (induction heating means) as a magnetic flux generation unit opposing the heating roller across the fuser belt, a pressure roller contacting the auxiliary fuser roller across the fuser belt, or the like. The induction heating unit comprises a coil portion (excitation coil) extending in the width direction (perpendicular to the direction of delivering the recording medium), a core unit opposing the coil portion (excitation coil core), or the like.

The fuser belt is heated at a position opposing the induction heating unit. The heated fuser belt heats and fuses a toner image onto the recording medium delivered between the auxiliary fuser roller and the pressure roller. More specifically, alternating current of high frequency flows through the coil portion so as to form an alternating field around the coil portion resulting in an eddy current in the vicinity of the surface of the heating roller. When the eddy current is generated in the vicinity of the heating roller, Joule heat is generated due to an electric resistance of the heating roller itself. The fuser belt stretched on the heating roller is heated by the Joule heat.

In such a fuser of the electromagnetic induction heating system, the heating element is directly heated by the electromagnetic induction. Hence, efficiency of heat exchange is greater than the efficiency of other systems such as a thermal roller system (heater lamp heating system). Accordingly, it is well known that the surface temperature (fusing temperature) can be increased to a desired temperature with a small amount of energy in a short period of time.

In the conventional fuser as above described, when the fuser belt as the fuser member is off to the side (displacement) in the width direction, an edge of the fuser belt may fail to make contact with the heating roller as the heating member so that there is a possibility of an overincrease of the temperature of the end of the heating roller in the width direction.

The operations are described more specifically below.

In the conventional fuser, in order to prevent the fuser belt opposing the induction heating unit from being off to the side in the width direction (displacement), protrusions (displacement stoppers) may be provided at both edges in the width direction of the fuser belt on the inside surface thereof. In addition, an engaging portion contacting the protrusion may be provided at a flange press-fitted in each of ends of the heating roller. That is, even if one end of the fuser belt is about to be off to the side in the width direction, the protrusion provided at the other end in the width direction contacts the engaging portion of the heating roller configured as the stopper so as to prevent the fuser belt from moving in the width direction.

However, in the case where the protrusion of the fuser belt runs on the engaging portion of the heating roller (including a case where the protrusion is not completely on the engaging portion, but is almost so), the fuser belt is moved apart from the heating roller there. Accordingly, when the fuser belt fails to contact the heating roller, the temperature of the heating roller immediately overincreases at the end thereof in the width direction where the contact failure occurs. This is because the heat of the heating roller, which is generated by the electromagnetic induction, is not transferred to the fuser belt (not contacting with each other) so that the heat is accumulated inside the heating roller. When the temperature of an end of the heating roller in the width direction overincreases, the temperature of the corresponding flange press-fitted in the end of the heating roller becomes greater than its heat-resistant temperature so that the flange may be damaged.

SUMMARY OF THE INVENTION

The present invention may provide a fuser that substantially obviates one or more problems caused by the limitations and disadvantages of the related art.

A preferred embodiment of the present invention may provide a fuser and an image forming device in which even if a heating member contacting a fuser member is off to a side in a width direction so that a contact failure at an edge in the width direction of the fuser member with the heating member occurs, an overincrease of temperature at the end in the width direction of the heating member is prevented.

To achieve these and other advantages in accordance with the purpose of the invention, an embodiment of the invention provides a fuser which includes a magnetic flux generation unit to generate magnetic flux, a heating member which is heated by electromagnetic induction of the magnetic flux, a fuser member to contact the heating member to be heated and heat a toner image so as to fuse the toner image onto a recording medium, a first detection unit to directly or indirectly detect a contacting state of the fuser member at an edge in a width direction of the fuser member with the heating member, and a magnetic flux adjusting member to reduce the magnetic flux acting upon an end in a width direction of the heating member in accordance with a detection result of the first detection unit.

According to at least one embodiment of the present invention, in a fuser of the electromagnetic induction heating system, the contacting state of the fuser member with the heating member is detected, and the magnetic flux is reduced acting upon the end of the heating member in the width direction in accordance with the detection result. Hence, it is possible to provide a fuser and an image forming device in which an overincrease of the temperature at the end of the heating member in the width direction is prevented even if the fuser member contacting the heating member is off to the side in the width direction causing a contact failure of the fuser member at the edge thereof with the heating member.

BRIEF DESCRIPTION OF THE DRAWINGS

Other objects and further features of the present invention will become apparent from the following detailed description when read in conjunction with the accompanying drawings, in which.

DESCRIPTION OF THE PREFERRED EMBODIMENTS

Figure 1:
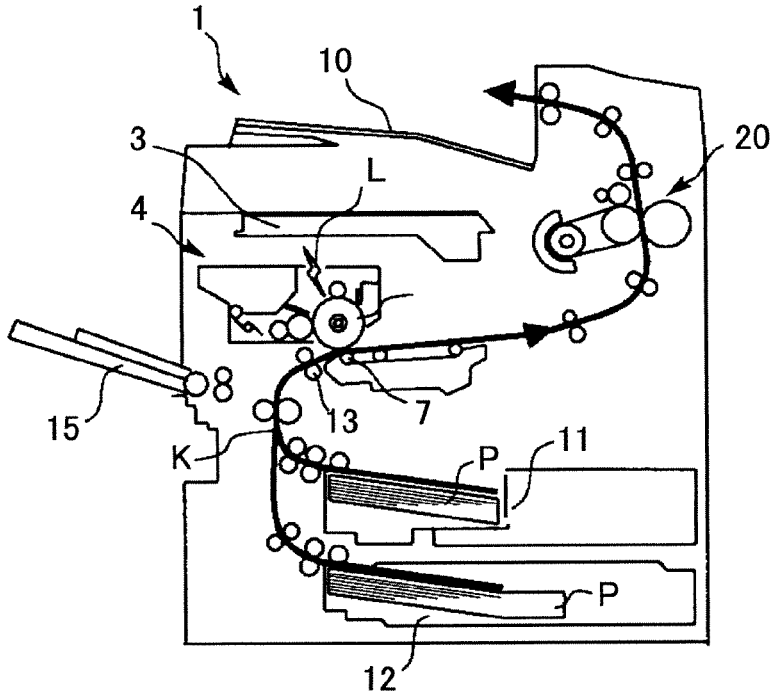
FIG. 1 is a view illustrating an entire structure of an image forming device according to a first embodiment of the present invention.

In the following, embodiments of the present invention are described with reference to the accompanying drawings. In the drawings, the same or corresponding components are assigned the same reference numerals, and overlapping explanation thereof is simplified or omitted as appropriate.

First Embodiment

A detailed description is given of a first embodiment of the present invention with reference to FIGS. 1 through 8.

First, a description is given of operations and components of the entire image forming device with reference to FIG. 1.

In FIG. 1, a laser printer main body 1 as the image forming device comprises an exposure unit 3 irradiating an exposure light L onto a photosensitive drum 18 based on image information, a process cartridge 4 as an imaging unit removably arranged in the main body 1, a transfer unit 7 transferring a toner image formed on the photosensitive drum 18 to a recording medium P, a paper catch tray 10 on which an output image is delivered, paper tray units 11 and 12 storing the recording medium P such as transfer paper, a resist roller 13 delivering the recording medium P to the transfer unit 7, a manual paper feed tray 15 mainly used for delivering another recording medium P having a size different from that of the recording medium P stored in the paper tray units 11 and 12, and a fuser 20 fusing an unfused image on the recording medium P according to an electromagnetic induction heating system.

With reference to FIG. 1, a description is given of operations of the image forming device upon forming normal images.

First, the exposure light L such as a laser beam in accordance with the image information is irradiated from the exposure unit 3 (writing unit) onto the photosensitive drum 18 of the process cartridge 4. The photosensitive drum 18 rotates in a counterclockwise direction in FIG. 1. The toner image corresponding to the image information is formed on the photosensitive drum 18 by a predetermined imaging process (steps of charging, exposing and developing). Then, the toner image formed on the photosensitive drum 18 is, at the transfer unit 7, transferred onto the recording medium P delivered by the resist rollers 13.

It should be noted that in the process cartridge 4, the photosensitive drum 18, a charging unit (not shown) for charging the surface of the photosensitive drum 18, a developing unit (not shown) for storing a toner (developer) and developing an electrostatic latent image formed on the photosensitive drum 18, and a cleaning unit (not shown) for removing the untransferred toner remaining on the photosensitive drum 18 are unified and arranged.

On the other hand, the recording medium P delivered to the transfer unit 7 is operated on as described below.

First, one of the paper tray units 11 and 12 in the main body 1 is automatically or manually selected (here, supposing that the paper tray unit 11 on top is selected) It should be noted that in each of the paper tray units 11 and 12, the recording medium P having a different size or the recording medium P having the same size but delivered in a different direction is stored.

A top sheet of the recording medium P stored in the paper tray unit 11 is delivered to a delivery path K. The sheet reaches the resist roller 13 by way of the delivery path K. The sheet of the recording medium P on the resist roller 13 is delivered to the transfer unit 7 in exact timing so as to adjust a position thereof to fit the toner image formed on the photosensitive drum 18.

After the step of transferring, the recording medium P passes through the transfer unit 7, and then reaches the fuser 20 via the delivery path. The recording medium P is delivered to a position between a fuser belt and a pressure roller, and then the toner image is fused on the recording medium P according to heat from the fuser belt and pressure from the pressure roller. The recording medium P on which the toner image is fused is supplied from the position between the fuser belt and the pressure roller to the paper catch tray 10.

Accordingly, a series of image forming processes are completed.

Figure 2:
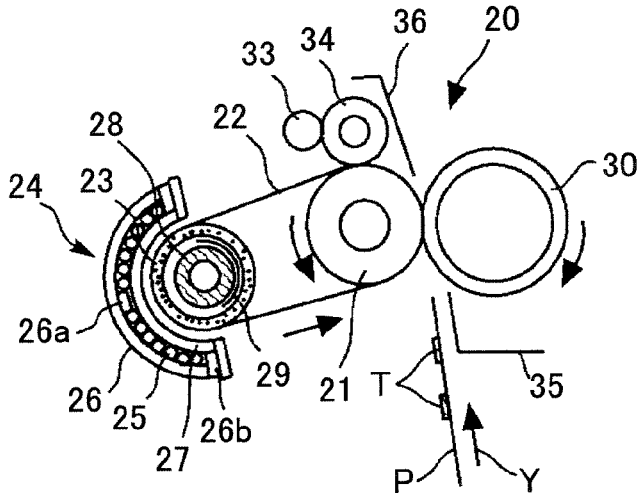
FIG. 2 is a more detailed view illustrating a fuser arranged in the image forming device of FIG. 1.

Next, a description is given of a structure and operations of the fuser 20 provided in the image forming device main body 1 with reference to FIG. 2.

As shown in FIG. 2, the fuser 20 mainly comprises an auxiliary fuser roller 21, the fuser belt 22 (fuser member), a heating roller 23 (heating member), an induction heating unit 24 (magnetic flux generation unit), a pressure roller 30, an oil coating roller 34, a guide plate 35, and a separating plate 36.

It should be noted that an elastic layer such as a silicon rubber is provided on the surface of the auxiliary fuser roller 21. The auxiliary fuser roller 21 is driven by a driving unit (not shown) so as to be rotated in the counterclockwise direction in FIG. 2.

Figure 3A:
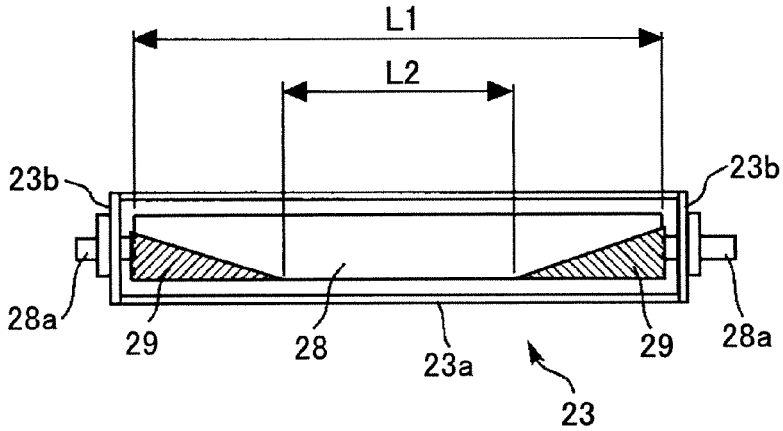
FIGS. 3A and 3B are views each illustrating a heating roller arranged in the fuser of FIG. 2.
Figure 3B:
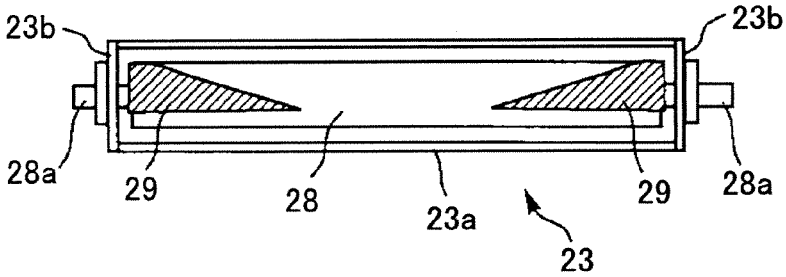
Figure 4:
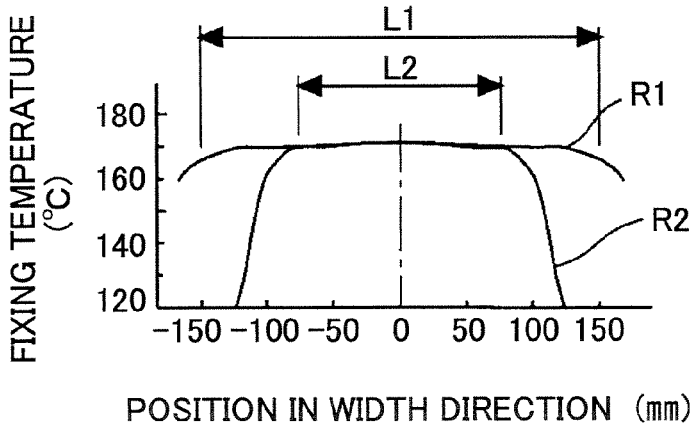
FIG. 4 is a graph showing a distribution of a temperature on a fuser belt in a width direction.

The heating roller 23 as the heating member mainly comprises a cylindrical portion 23*a* formed by a non-magnetic member such as SUS304 as shown in FIGS. 3 and 4. The heating roller 23 rotates in the counterclockwise direction in FIG. 2. In the heating roller 23, an internal core 28 formed of a ferromagnetic material such as a ferrite, and magnetic flux shields 29 (magnetic flux adjusting member) formed of a material having a low magnetic permeability such as copper are provided. The internal core 28 opposes a coil portion 25 across the fuser belt 22 and the heating roller 23. Further, the magnetic flux shield 29 is configured to shield both ends of the internal core 28 in the width direction of the fuser belt 22.

The internal core 28 and the magnetic flux shield 29 are configured to be unified and rotate together. The rotation of the internal core 28 and the magnetic flux shield 29 is performed separate from the rotation of the heating roller 23. As for the structure and operations of the heating roller 23, a detailed description is given below.

The fuser belt 22 as the fuser member is stretched around the heating roller 23 and the auxiliary fuser roller 21 and supported thereby. The fuser belt 22 is endless and has a multiple layer structure comprising a base layer formed by a polyimide resin, a heating layer formed by silver, nickel, iron, and the like, and a release layer (surface layer) formed by a fluorine compound. The release layer of the fuser belt 22 guarantees releasability of a toner T.

The induction heating unit 24 as the magnetic flux generation unit comprises the coil portion 25, a core unit 26 having a center core 26*a* and side cores 26*b*, and a coil guide 27.

It should be noted that the coil portion 25 comprises a Litz wire formed by binding thin wires, which Litz wire extends in the width direction (direction orthogonal to the plane of the page in FIG. 2) so as to cover a part of the fuser belt 22 mounted on the heating roller 23. The coil guide 27 formed by resin with high heat resistance retains the coil portion 25 and the core unit 26. The core unit 26 is formed by materials with high magnetic permeability such as ferrite. The core unit 26 is so provided as to face the coil portion 25 extending in the width direction. One of the side cores 26*b* is provided at each end of the coil portion 25. The center core 26*a* is provided at the center of the coil portion 25.

It should be noted that the internal core 28 is provided in the heating roller 23 in the first embodiment of the present invention. Accordingly, a satisfactory magnetic field is formed between the core unit 26 and the internal core 28 so as to heat the heating roller 23 and the fuser belt 22 efficiently.

Further, the pressure roller 30 formed of an elastic layer such as fluororubber, silicon rubber and the like on a metal core is pressed onto the auxiliary fuser roller 21 with the fuser belt 22 therebetween. The recording medium P is delivered to a contacting portion (fusing nip portion) between the fuser belt 22 and the pressure roller 30.

The guide plate 35 is provided at a position where the recording medium P enters the contacting portion between the fuser belt 22 and the pressure roller 30, which guide plate 35 guides the recording medium P to be delivered.

The separating plate 36 is provided at a position where the recording medium P exits the contacting portion between the fuser belt 22 and the pressure roller 30, which separating plate 36 helps the recording medium P to be separated from the fuser belt 22.

The oil coating roller 34 contacts a part of an outer surface of the fuser belt 22. The oil coating roller 34 supplies oil such as silicon oil onto the fuser belt 22. Accordingly, the releasability of the toner on the fuser belt 22 is further enhanced. It should be noted that the cleaning roller 33 contacts the oil coating roller 34 so as to remove waste from the surface of the oil coating roller 34.

It should be noted that a thermostat (not shown) contacts a part of an outer surface of the heating roller 23 (at a center of the heating roller 23 in the width direction). When the temperature of the heating roller 23 detected by the thermostat exceeds a predetermined temperature, the thermostat disconnects electricity to the induction heating unit 24.

Further, a thermistor (or a thermopile) is provided at a center of the fuser belt 22 in the width direction for detecting a surface temperature (fusing temperature) of the fuser belt 22 so as to control the fusing temperature.

The fuser 20 configured as described above operates as follows.

The fuser belt 22 is rotated in the direction shown by an arrow in FIG. 2 according to rotation of the auxiliary fuser roller 21. The heating roller 23 is also rotated in the counterclockwise direction. Further, the pressure roller 30 is rotated in the clockwise direction shown by another arrow in FIG. 2. The fuser belt 22 is heated at a position opposing the induction heating portion 24. More specifically, alternating current having a high frequency flows through the coil portion 25 so as to form magnetic lines of flux alternately switching bidirectionally between the core unit 26 and the internal core 28. At this time, an eddy current is generated on the surface of the heating roller 23 and Joule heat is generated according to the electric resistance of the heating roller 23 itself. According to the Joule heat, the fuser belt 22 mounted on the heating roller 23 is heated. It should be noted that in the first embodiment, the fuser belt 22 is heated by the heating roller 23 since the fuser belt 22 includes an exothermic layer. In addition, the fuser belt 22 itself is heated according to electromagnetic induction heating by the induction heating unit 24.

Thereafter, the surface of the fuser belt 22 heated by the induction heating unit 24 reaches a contacting portion with the pressure roller 30. Then, the toner image T on the recording medium P to be delivered is heated and dissolved.

More specifically, the recording medium P retaining the toner image T through the imaging step described above is guided to a position between the fuser belt 22 and the pressure roller 30 by the guide plate 35 (moving in a direction shown by an arrow Y). The toner image T is fused on the recording medium P according to the heat from the fuser belt 22 and the pressure from the pressure roller 30. The recording medium P is then delivered from the position between the fuser belt 22 and the pressure roller 30.

A detailed description is given of a configuration and operations of the heating roller 23 with reference to FIGS. 3A through 4.

FIGS. 3A and 3B show the heating roller 23 arranged in the fuser 20 of FIG. 2 viewed from the induction heating unit 24 in the width direction for the purpose of promoting easy understanding of the structure of the internal core 28 and the magnetic flux shield 29 arranged inside. FIG. 3B is a view in which the internal core 28 and the magnetic flux shield 29 shown in FIG. 3A are rotated by a predetermined angle.

As shown in FIG. 3A, in the heating roller 23, the internal core 28 having a width L1 and a cylindrical shape and the magnetic flux shield 29 attached to both ends of the internal core 28 are rotatably arranged. In the case where the fuser belt 22 is off to the side (displacement) in the width direction resulting in failure to contact the heating roller 23 at the end thereof, the magnetic flux shield 29 as the magnetic flux adjusting member is operable to prevent an overincrease of the temperature of the heating roller 23 at the end thereof. More specifically, in the case where the contact failure occurs at the edge of the fuser belt 22 in the width direction, the internal core 28 is rotated together with the magnetic flux shield 29 so that the magnetic flux shield 29 shields the end of the internal core 28, which end opposes the coil portion 25 (mainly at a position of the center core 26*a*) of the induction heating unit 24, and lowers the magnetic flux acting upon the end of the heating roller 23. A description thereof is given below.

On the other hand, the magnetic flux shield 29 in the first embodiment, in addition to the above described operation, is operable to adjust a scope to be heated so as to prevent an increase of the temperature in a region over the width of the recording medium P on the fuser belt 22. More specifically, the magnetic flux shield 29 is configured to adjust progressively the scope to be shielded of the surface of the internal core 28 from the end thereof. Accordingly, the angle of rotating the internal core 28 together with the magnetic flux shield 29 is adjusted so as to change the scope to be shielded of the internal core 28, which scope opposes the coil portion 25 of the induction heating unit 24.

It should be noted that the rotation of the internal core 28 and the magnetic flux shield 29 is driven by a stepping motor (not shown) as a driving unit joined to an axis 28*a* of the internal core 28. The stepping motor belongs to a driving system different from that of a driving motor (not shown) driving the auxiliary fuser roller 21, the fuser belt 22, the heating roller 23, and the like.

More specifically, the internal core 28 and the magnetic flux shield 29 in a position shown in FIG. 3A are rotated 90 degrees to the position shown in FIG. 3B. At this time, a maximum scope of the internal core 28 opposing the induction heating unit 24 is shielded. In the scope shielded by the magnetic flux shield 29, the magnetic lines of flux to be formed between the induction heating unit 24 and the core unit 26 are shielded. Thus, a region of the fuser belt 22 corresponding to the shielded scope is hardly heated. Hence, on the fuser belt 22, only a scope shown by the length L2 at the center is to be heated.

The position shown in FIG. 3B can be better adapted to a case of continuously fusing the toner image onto a recording medium P having the length L2. More specifically, in the case of fusing the toner image onto the recording medium P having a minimum length (for example, 148 mm) which can be dealt with by the image forming device, the position of the internal core 28 and the magnetic flux shield 29 in the rotating direction is fixed as shown in FIG. 3B, and the fusing step described with reference to FIG. 2 is performed.

At this time, as shown by a continuous line R2 of FIG. 4, the distribution of the fusing temperature on the fuser belt 22 in the width direction is leveled in the range of the width L2 so that satisfactory fusing can be obtained for the recording medium P having the width L2. Further, it should be noted that the fuser belt 22 can be protected from thermal failure since the increase of the temperature is prevented in the scope exceeding the length L2 on the fuser belt 22.

FIG. 4 is a graph showing the distribution of the temperature on the fuser belt 22 in the width direction. In FIG. 4, the horizontal axis shows a position of the fuser belt 22 in the width direction, while the vertical axis shows the temperature (fusing temperature) of the surface of the fuser belt 22. Here, the position "0" on the horizontal axis shows the center of the fuser belt 22 in the width direction. The continuous line R1 shows a distribution of the temperature when the scope shielded by the magnetic flux shield 29 is minimum so that the scope to be heated of the fuser belt 22 is maximum. On the other hand, the continuous line R2 shows a distribution of the temperature when the scope to be shielded by the magnetic flux shield 29 is maximum so that the scope to be heated of the fuser belt 22 is minimum.

As the internal core 28 and the magnetic flux shield 29 as shown in FIG. 3B are further rotated 180 degrees, a maximum scope of an internal coil 23*a* opposing the induction heating unit 24 becomes unshielded by the magnetic flux shields 29. According to the magnetic lines of flux generated between the internal core 28 unshielded by the magnetic flux shields 29 and the core unit 26 of the induction heating unit 24, a maximum scope (the entire scope of the length L1) of the fuser belt 22 is heated.

This further rotated position can be better adapted to a case of continuously fusing the recording medium P having the length L1. More specifically, in the case of fusing the toner image onto the recording medium P having a maximum length (for example, 297 mm) which can be dealt with by the image forming device, the position of the internal core 28 and the magnetic flux shield 29 in the rotating direction is fixed at 180 degrees from the position shown in FIG. 3B. Then, the fusing step described with reference to FIG. 2 is performed. At this time, as shown by the continuous line R1 in FIG. 4, the distribution of the fusing temperature in the width direction on the fuser belt 22 is leveled in the range of the width L1 so that satisfactory fusing can be obtained for the recording medium P having the width L1.

Further, in the case of fusing the toner image (forming an image) onto the recording medium P having a width between L2 and L1, the internal core 28 and the magnetic flux shield 29 are rotated to a certain angle in response to the width of the recording medium P so as to adjust a scope to be heated on the fuser belt 22 to the width range. Accordingly, the distribution of the fusing temperature on the fuser belt 22 in the width direction is leveled in the width range of the recording medium P so that satisfactory fusing can be obtained. Moreover, it should be noted that the fuser belt 22 can be protected from thermal failure since the increase of the temperature is prevented in the scope exceeding the width of the recording medium P on the fuser belt 22.

It should be noted that the size of the recording medium P in the width direction is determined by the control unit according to a detection result obtained by size detection sensors (photo sensors) arranged at the paper tray units 11, 12 and the manual paper feed tray 15 or an operating information input via an operations unit. The magnetic flux shield 29 is controlled according to the scope in the width direction detected by a second detection unit such as the size detection sensor.

With reference to FIGS. 5 through 8, a characteristic structure and operations of the fuser 20 according to the first embodiment are described in detail.

Figure 5:
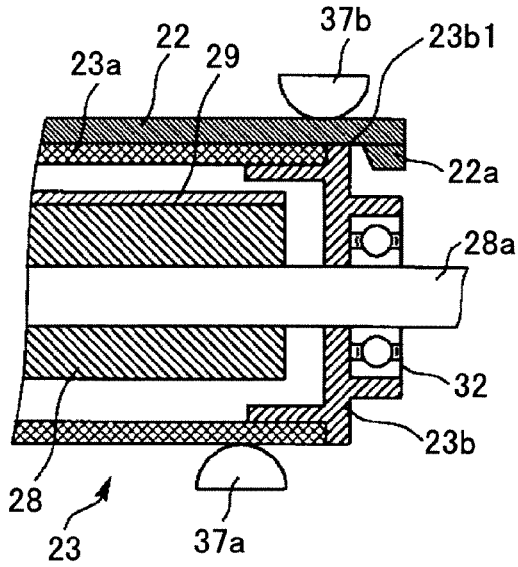
FIG. 5 is a cross-sectional view illustrating an end in the width direction of the heating roller.
Figure 6:
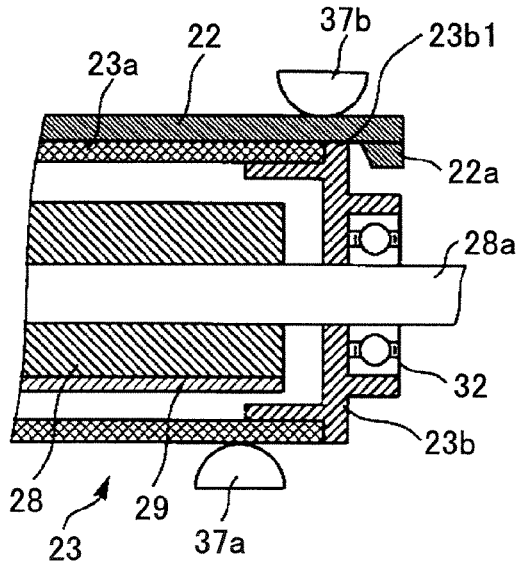
FIG. 6 is a cross-sectional view illustrating where an internal core provided in the inside of the heating roller of FIG. 5 is rotated by a predetermined angle.

FIG. 5 is a cross-sectional view illustrating a structure in detail of the end of the heating roller 23 containing the internal core 28 and the magnetic flux shield 29 therein, which heating roller 23 the fuser belt 22 contacts. The center core 26*a* is arranged over the structure shown in FIG. 5. Further, FIG. 6 is a view illustrating the same structure as shown in FIG. 5 in which the magnetic flux shield 29 together with the internal core 28 shown in FIG. 5 are rotated 180 degrees.

As shown in FIG. 5, the heating roller 23 comprises a cylindrical portion 23*a* (main portion of the heating member to be heated by the electromagnetic induction) formed by a non-magnetic member such as SUS304, a flange 23*b* formed by resin press-fitted in each end of the cylindrical portion 23*a*, and a bearing 32 provided in the flange 23*b*. The heating roller 23 is rotatably supported by the axis 28*a* of the internal core 28 via the bearing 32. The heating roller 23 rotates in a certain direction together with running of the fuser belt 22 according to frictional resistance generated between the heating roller 23 and the fuser belt 22. On the other hand, the internal core 28, independent from the rotation of the heating roller 23, is driven to be rotated at a certain timing (when the overincrease of the temperature occurs at the end in the width direction or when the size of the recording medium P is changed) together with the axis 28*a* joined to the stepping motor (drive unit, not shown).

Further, a protrusion 22*a* (displacement stopper) formed of rubber is provided at each edge in the width direction of the fuser belt 22 on the internal surface thereof. Moreover, an engaging portion 23*b*1 contacting the protrusion 22*a* of the fuser belt 22 is arranged around the flange 23*b*. Accordingly, even if the fuser belt 22 is off to one end in the width direction (moving to the left as shown in FIG. 5), the protrusion 22*a* on the other end (the end shown in FIG. 5) contacts the engaging portion 23*b*1 of the heating roller 23, which engaging portion 23*b*1 is configured to be a stopper, so as to prevent the fuser belt 22 from moving further in the width direction.

In addition, on each end of the external surface of the heating roller 23, a first temperature detection sensor 37*a* is provided for detecting a temperature (T1) on the corresponding end of the heating roller 23. Further, on the external surface of the fuser belt 22 contacting the heating roller 23, at each edge of the fuser belt 22 in the width direction, a second temperature sensor 37*b* is provided for detecting a temperature (T2) of the edge of the fuser belt 22. These temperature sensors (temperature detection units) 37*a* and 37*b* are configured to indirectly detect the contacting state of the edges of the fuser belt 22 with the heating roller 23.

Figure 7:
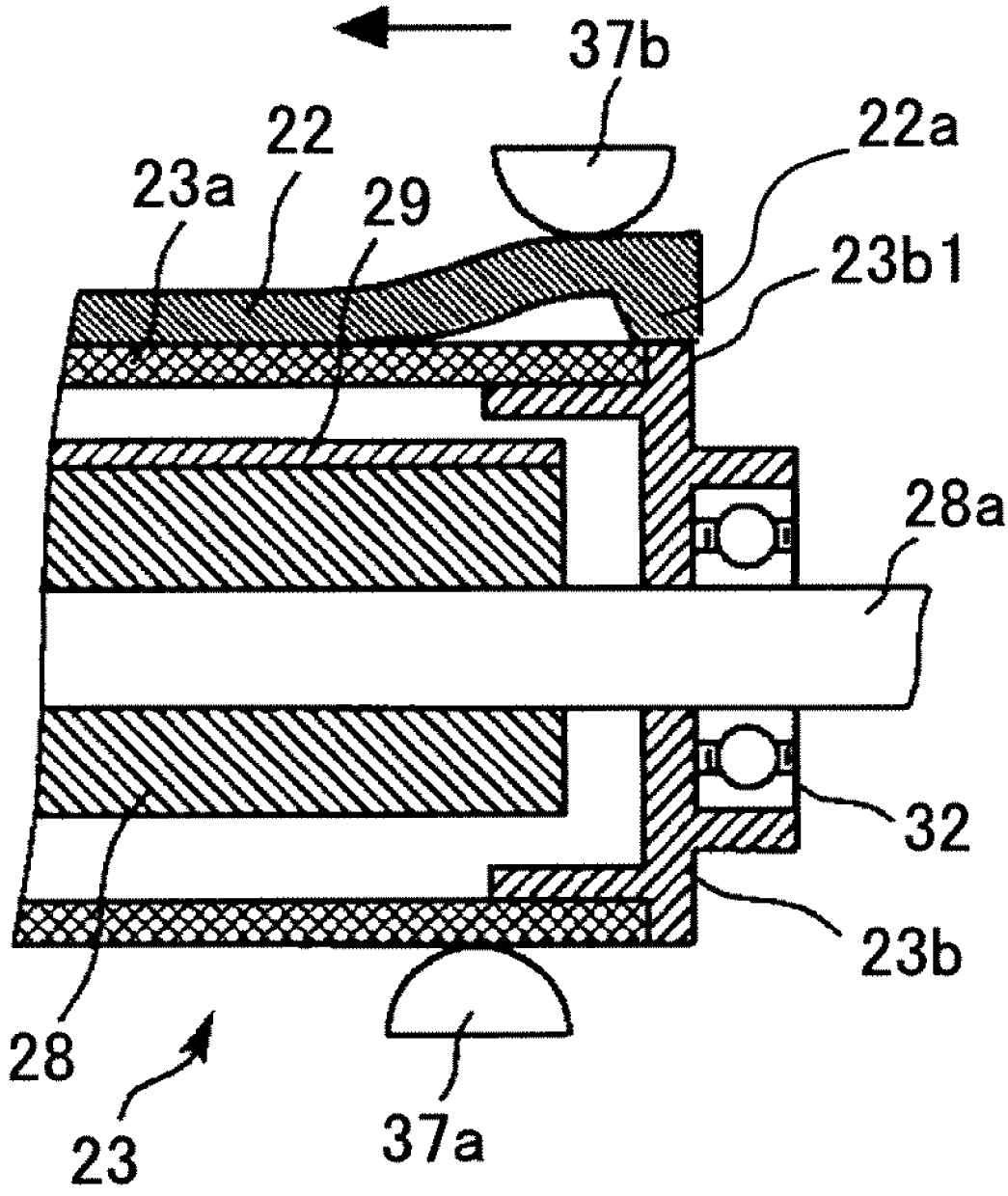
FIG. 7 is a cross-sectional view illustrating a state in which a contact failure of the fuser belt with the heating roller of FIG. 5 occurs.

More specifically, as shown in FIG. 7, in the case where the fuser belt 22 is off to the side in the arrow direction so that the protrusion 22*a* of the fuser belt 22 moves onto the engaging portion 23*b*1 of the heating roller 23 (including a case such that the protrusion 22*a* does not completely move onto the engaging portion 23*b*1, but seems to almost do so), the fuser belt 22 is separated from the heating roller 23 there. As described above, when the fuser belt 22 fails to contact the heating roller 23, the temperature of the heating roller 23 overincreases instantaneously at a part where the contact failure occurs. This is because the heat of the heating roller 23 which is generated by electromagnetic induction is not transferred to the fuser belt 22 but stored inside the heating roller 23. Hence, when the temperature of the end of the heating roller 23 overincreases, the temperature of the flange 23*b* press-fitted in the end of the heating roller 23 exceeds its heat-resistant temperature so that the flange 23*b* is damaged. On the other hand, at the edge of the fuser belt 22 separated from the heating roller 23, the temperature is reduced.

In the first embodiment, the contact failure (lifting) of the fuser belt 22 at the edge thereof in the width direction is detected indirectly according to the temperature difference between the temperature (T1) at the end of the heating roller 23 and the temperature (T2) at the edge of the fuser belt 22. That is, when the temperature difference (T1−T2) exceeds a certain value, it is determined that the normal thermal transmission from the heating roller 23 to the fuser belt 22 has failed, and thus, a contact failure is caused by the displacement of the fuser belt 22.

If it is determined that the contact failure of the fuser belt 22 occurs, the magnetic flux shield 29 is moved (driven to be rotated) to a position opposing the coil portion 25 (to be in the position shown in FIG. 5). With this movement, the magnetic flux shield 29 reduces the magnetic flux acting upon the end of the heating roller 23 (where the overincrease of the temperature occurs) so as to prevent the overincrease of the temperature at the end of the heating roller 23 in advance by reducing the electromagnetic induction heating. If it is determined that the contact failure of the fuser belt 22 does not occur (normal state), as shown in FIG. 6, the magnetic flux shield 29 is to be moved to a position (home position) which does not oppose the coil portion 25.

Figure 8:
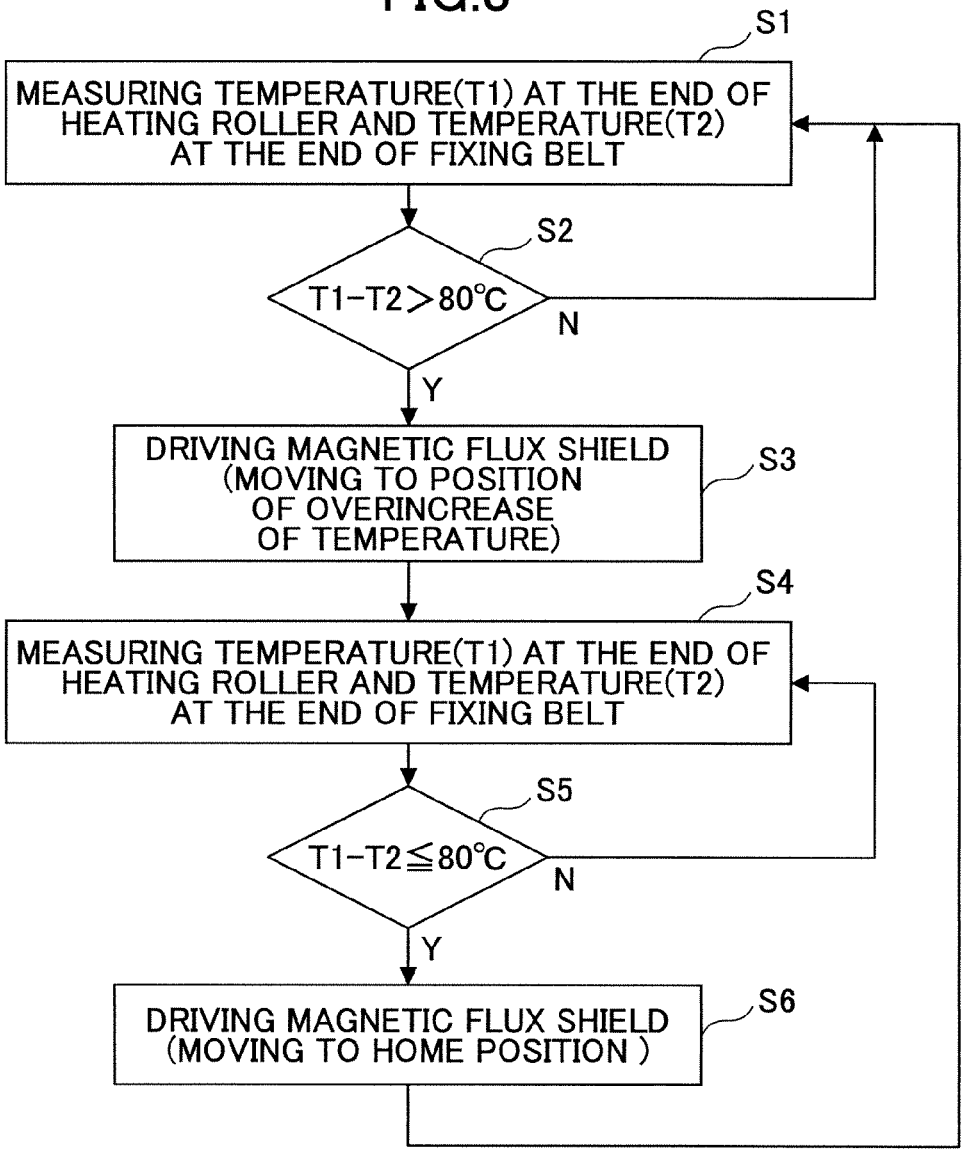
FIG. 8 is a flowchart illustrating a control process performed in the fuser.

A description is given of specific operations performed in the fuser 20 according to the first embodiment with reference to FIG. 8.

First, the first temperature sensor 37*a* measures the temperature (T1) at the end of the heating roller 23 in the width direction. Simultaneously, the second temperature sensor 37*b* measures the temperature (T2) at the edge of the fuser belt 22. Then, the temperature difference (T1−T2) is obtained (Step S1).

Next, it is determined whether the temperature difference (T1−T2) between the heating roller 23 and the fuser belt 22 is greater than a certain value (Step S2). As a result, if it is determined that the temperature difference is not greater than the certain value, the contact failure of the fuser belt 22 has not occurred so that Step S1 and later are repeated.

On the contrary, if the temperature difference is greater than the certain value (T1−T2>80 °C.), it is determined that the contact failure of the fuser belt 22 has occurred, and the magnetic flux shields 29 are moved to the position as shown in FIG. 5 to reduce the magnetic flux acting upon the end of the heating roller 23 (Step S3).

Thereafter, in the same manner as Step S1, the temperature difference (T1−T2) between the temperature at the edge of the heating roller 23 and the temperature at the end of the fuser belt 22 is obtained (Step S4). Then, it is determined whether the temperature difference (T1−T2) of the heating roller 23 and the fuser belt 22 is less than or equal to the certain value (T1−T2 is equal to or less than 80 °C.) (Step S5).

As a result, if the temperature difference is less than or equal to the certain value (T1−T2 is equal to or less than 80 °C.), it is determined that the overincrease at the end of the heating roller 23 is prevented, and thus, the magnetic flux shields 29 are moved to the home position (shown in FIG. 6) (Step S6). Hereinafter, Step S1 and later are repeated.

As described above, in the first embodiment, the contacting state of the fuser belt 22 with the heating roller 23 is detected indirectly. The magnetic flux acting upon the end of the heating roller 23 in the width direction is reduced in accordance with the detection result. Accordingly, even if the fuser belt 22 contacting the heating roller 23 is off to the side so that contact failure at the edge of the fuser belt 22 with the heating roller 23 occurs, the overincrease of the temperature at the end of the heating roller 23 is prevented. As a result, a secondary problem such as thermal failure of the flange 23*b* can be prevented.

It should be noted that in the first embodiment, the heating roller 23 is used as a heating member, and the fuser belt 22 is used as a fuser member and a heating member by forming a heating layer thereon. On the other hand, the fuser belt 22 may be used as only the fuser member without forming the heating layer thereon so that only the heating roller 23 is used as the heating member. In this case, the same effect can be obtained as in the first embodiment by detecting the contacting state of the fuser belt 22 with the heating roller 23 and reducing the magnetic flux acting upon the end of the heating roller 23 in accordance with the detection result of the contacting state.

Further, in the first embodiment, when the overincrease of the temperature at one end of the heating roller 23 is caused by the failure of the fuser belt 22 to make contact, magnetic flux on both ends of the heating roller 23 is reduced by the magnetic flux shield 29. On the contrary, the fuser may be configured to reduce the magnetic flux at only one end of the heating roller 23 where the overincrease of the temperature is caused. In this case, separate from the above described magnetic flux shield (provided for changing the range to be heated in accordance with the width of the recording medium P), other magnetic flux shields for reducing the magnetic flux at corresponding ends in the width direction separately are arranged in a circumferential direction of the internal core 28 by forming a phase difference.

Second Embodiment

Figure 9:
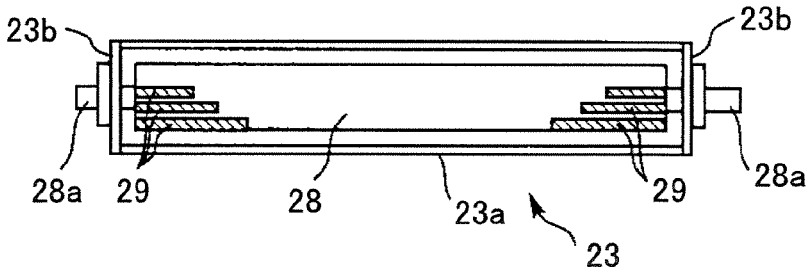
FIG. 9 is a view illustrating a heating roller arranged in the fuser according to a second embodiment of the present invention.

The second embodiment of the present invention is described in details with reference to FIG. 9.

FIG. 9 is a view illustrating the heating roller 23 arranged in the fuser 20 according to the second embodiment. FIG. 9 corresponds to FIG. 3A according to the first embodiment. In the second embodiment, the shape of the magnetic flux shields 29 arranged inside of the heating roller 23 is different from the shape of the magnetic flux shield 29 according to the first embodiment.

As shown in FIG. 9, inside of the heating roller 23, the internal core 28 and the magnetic flux shields 29 are rotatably arranged.

The magnetic flux shields 29 unified with the internal core 28 differ from the magnetic flux shield 29 of the first embodiment in being configured to reduce (or increase) the range to be shielded of the circumference surface of the internal core 28 in progressive steps (3 steps in the present embodiment). In the second embodiment, it is possible to reduce the magnetic flux acting upon the end of the heating roller 23 according to need. Further, the internal core 28 is rotated together with the magnetic flux shields 29 so as to change the range to be shielded of the internal core 28 opposing the coil portion 25 of the induction heating unit 24.

In the second embodiment, as well as the first embodiment, the internal core 28 and the magnetic flux shields 29 are rotated by a predetermined angle in accordance with the width of the recording medium P so as to adjust the range to be heated of the fuser belt 22 to be the width of the recording medium P.

In the second embodiment, as well as the first embodiment, the temperature detection units 37*a* and 37*b* indirectly detect a contact failure (lifting) at the edge of the fuser belt 22 in the width direction. If it is determined that the contact failure of the fuser belt 22 has occurred, the magnetic flux shields 29 are controlled to be moved to a position opposing the coil portion 25.

As described above, in the second embodiment, the contacting state of the fuser belt 22 with the heating roller 23 is detected, and the magnetic flux acting upon the end of the heating roller 23 is reduced in accordance with the detection result. With this, the fuser belt 22 contacting the heating roller 23 is moved in the width direction so that the overincrease of the temperature at the end of the heating roller 23 can be prevented even if the end of the fuser belt 22 fails to contact the heating roller 23.

Third Embodiment

Figure 10:
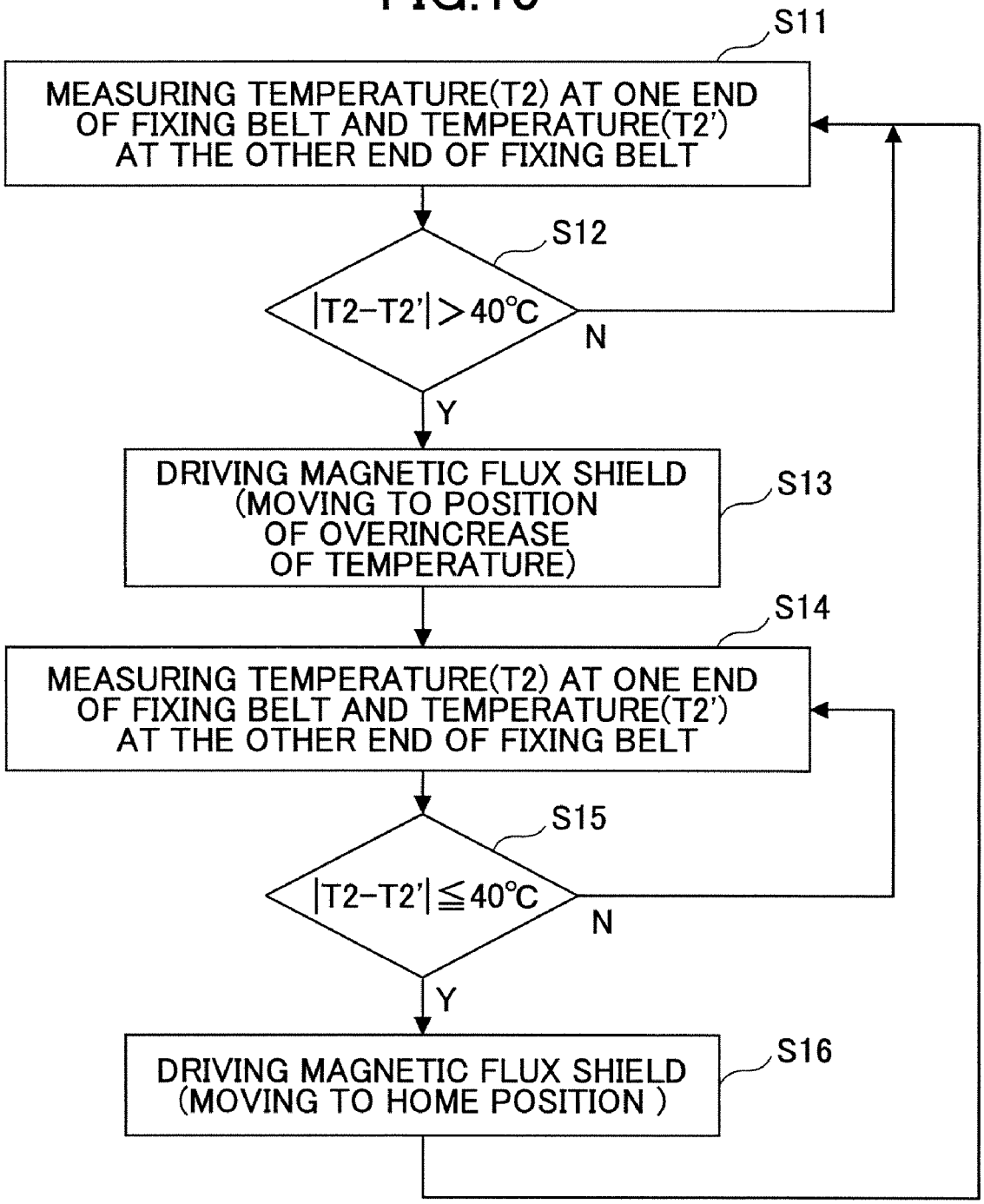
FIG. 10 is a flowchart illustrating a control process performed in the fuser according to a third embodiment of the present invention.

The third embodiment according to the present invention is described in details with reference to FIG. 10.

FIG. 10 is a flowchart showing the control performed in the fuser 20 according to the third embodiment. FIG. 10 corresponds to FIG. 8 according to the first embodiment. The detection units of the third embodiment detecting the failure of the edge of the fuser belt 22 to contact the heating roller 23 differ from the detection units of the first embodiment.

In the fuser according to the third embodiment, the temperature detection sensors 37*b* are arranged at both edges of the fuser belt 22 in the width direction on the external circumferential surface for detecting temperatures (T2 and T2') at corresponding edges of the fuser belt 22. The temperature sensors (temperature detection units) 37*b* arranged at both edges of the fuser belt 22 are operable to indirectly detect the contacting state at both edges of the fuser belt 22 with the heating roller 23 as a detection unit.

In the third embodiment, the contact failure (lifting) of the fuser belt 22 at the edge thereof in the width direction is indirectly detected according to the temperature difference between the temperature (T2) at one edge of the fuser belt 22 and the temperature (T2') at the other edge of the fuser belt 22. That is, if the temperature difference (|T2−T2'|) between the edges of the fuser belt 22 becomes greater than a predetermined value, it is determined that the normal thermal transmission from the heating roller 23 to the fuser belt 22 has failed, and thus, the contact failure of the fuser belt 22 has occurred at one end thereof according to the displacement.

If it is determined that the contact failure of the fuser belt 22 has occurred, the magnetic flux shields 29 are moved to positions opposing the coil portion 25. With this movement, the magnetic flux acting upon the end of the heating roller 23 (the edge of the fuser belt 22 where the temperature is lower than that of the other edge) is reduced so as to prevent the overincrease of the temperature of the end in the width direction of the heating roller 23 in advance.

A description is given of a specific control operation performed in the fuser 20 according to the third embodiment with reference to FIG. 10.

First, the temperature sensor 37*b* on one edge of the fuser belt 22 detects the temperature (T2) of the edge of the fuser belt 22 in the width direction, and simultaneously the temperature sensor 37*b* on the other edge detects the temperature (T2') of the other edge of the fuser belt 22 so as to obtain the temperature difference (|T2−T2'|) (Step S11).

Thereafter, it is determined whether the temperature difference between the edges of the fuser belt 22 is greater than a predetermined value (|T2−T2'|>40 °C.) (Step S12). As a result, if the temperature difference is less than or equal to the predetermined value, it is determined that the contact failure of the fuser belt 22 has not occurred. Hence, the Step S11 and later are repeated.

On the contrary, if the temperature difference is greater than the predetermined value (|T2−T2'|>40 °C.), it is determined that the contact failure of the fuser belt 22 has occurred, and thus, the magnetic flux shields 29 are moved to the position for reducing the magnetic flux (Step S13).

Thereafter, the temperature difference (|T2−T2'|) between the ends of the fuser belt 22 is obtained again (Step S14). Then, it is determined whether the temperature difference between the edges of the fuser belt 22 is less than or equal to the predetermined value (|T2−T2'|<=40 °C.) (Step S15).

As a result, if the temperature difference is less than or equal to the predetermined value (|T2−T2'|<=40 °C.), it is determined that the overincrease of the temperature at the end of the heating roller 23 is prevented, and thus, the magnetic flux shields 29 are moved to the home position (Step S16). Then, the Step S11 and later are repeated.

As described above, in the third embodiment, the contacting state of the fuser belt 22 with the heating roller 23 is detected, and the magnetic flux acting upon the end of the heating roller 23 is reduced in accordance with the detection result. With this, the fuser belt 22 contacting the heating roller 23 is moved in the width direction so that the overincrease of the temperature at the end of the heating roller 23 can be prevented even if the contact failure at the edge of the fuser belt 22 with the heating roller 23 occurs.

It should be noted that in the third embodiment, when the temperature difference between the edges of the fuser belt 22 in the width direction becomes greater than the predetermined value, the magnetic flux is controlled to be reduced for at least one of the edges (where the contact failure occurs) in which edge the temperature is less than the temperature of the other edge. On the contrary, when the temperature difference between the ends of the heating roller 23 is greater than the predetermined value, the magnetic flux may be controlled to be reduced for at least one of the ends (where the contact failure occurs) in which end the temperature is greater than the temperature of the other end. In this case, the effect similar to the effect of the third embodiment can be obtained.

Fourth Embodiment

The fourth embodiment is described in detail with reference to FIG. 11.

Figure 11:
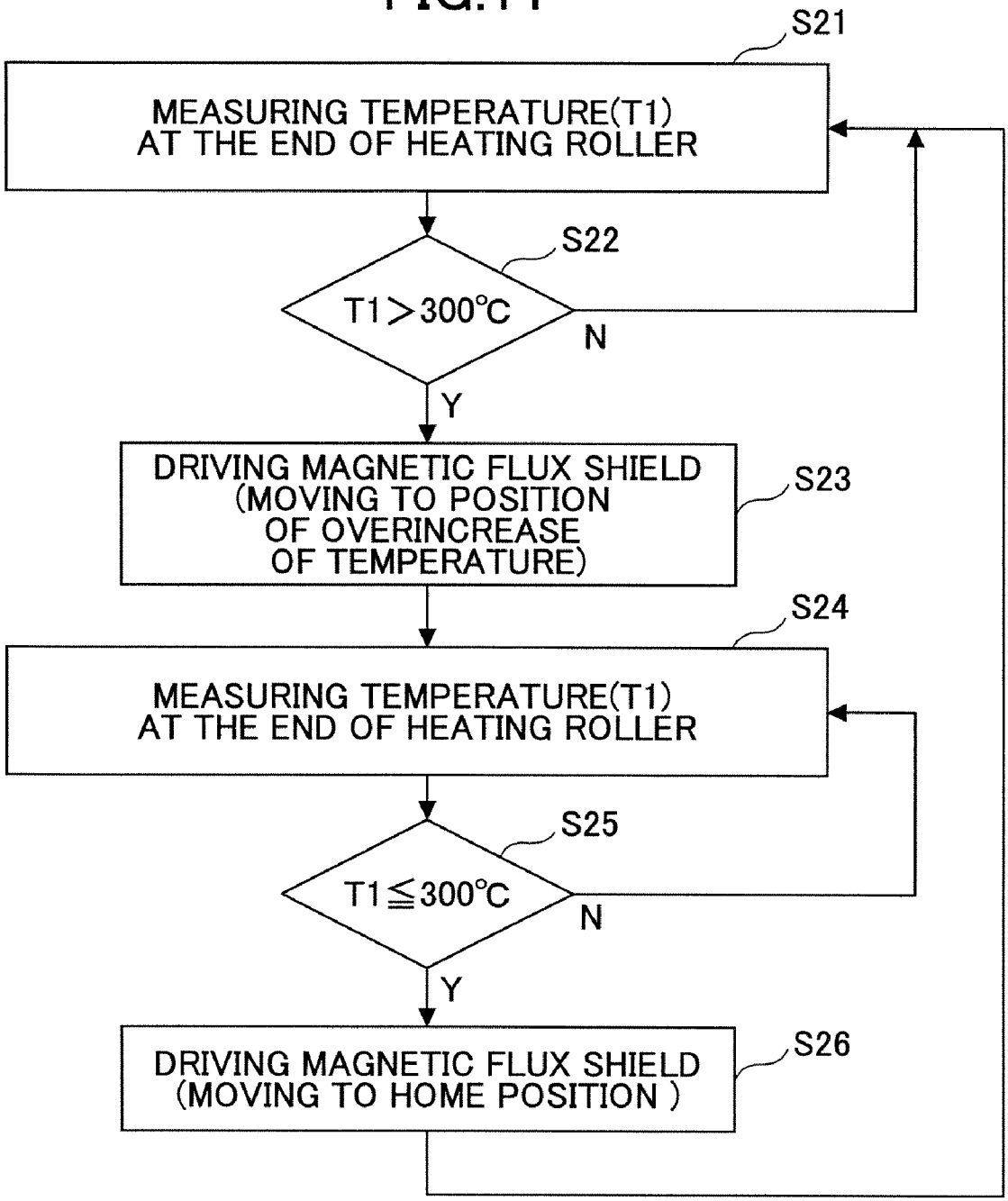
FIG. 11 is a flowchart illustrating a control process performed in the fuser according to a fourth embodiment of the present invention.

FIG. 11 is a flowchart showing the control operations performed in the fuser 20 according to the fourth embodiment. FIG. 11 corresponds to FIG. 8 according to the first embodiment. The detection units of the fourth embodiment detecting the failure of the edge of the fuser belt 22 in the width direction to contact the heating roller 23 differ from the detection units of the first embodiment.

In the fuser according to the fourth embodiment, the temperature detection sensors 37*a* are arranged at both ends of the heating roller 23 on the external circumferential surface for detecting a temperature at corresponding ends of the heating roller 23 in the width direction. The temperature sensors (temperature detection units) 37*a* arranged at corresponding ends of the heating roller 23 are operable to indirectly detect the contacting state at both ends of the heating roller 23 with the fuser belt 22 as a detection unit.

In the fourth embodiment, the contact failure (lifting) of the edge of the fuser belt 22 in the width direction is indirectly detected according to only the temperature (T1) at the corresponding end of the heating roller 23. That is, if the temperature (T1) of the corresponding end of the heating roller 23 becomes greater than a predetermined value, it is determined that normal thermal transmission from the heating roller 23 to the fuser belt 22 has failed, and thus, the contact failure of the edge of the fuser belt 22 has occurred according to the displacement.

If it is determined that the contact failure of the fuser belt 22 has occurred, the magnetic flux shields 29 are moved to a position opposing the coil portion 25. With this movement, the magnetic flux acting upon the end of the heating roller 23 is reduced so as to prevent the overincrease of the temperature of the corresponding end in advance.

A description is given of a specific control operation performed in the fuser 20 according to the fourth embodiment with reference to FIG. 11.

First, the temperature sensor 37*a* measures the temperature (T1) of the end of the heating roller 23 in the width direction (Step S21). Thereafter, it is determined whether the temperature (T1) of the end of the heating roller 23 is greater than a predetermined value (T1>300 °C.) (Step S22). As a result, if the temperature is less than or equal to the predetermined value, it is determined that the contact failure of the fuser belt 22 has not occurred. Hence, Step S21 and later are repeated.

On the contrary, if the temperature is greater than the predetermined value (T1>300 °C.), it is determined that the contact failure of the fuser belt 22 has occurred, and thus, the magnetic flux shields 29 are moved to the position for reducing the magnetic flux at the corresponding end (Step S23).

Thereafter, the temperature (T1) of the end of the heating roller 23 is measured again (Step S24). Then, it is determined whether the temperature of the end of the heating roller 23 is less than or equal to the predetermined value (T1<=300 °C.) (Step S25).

As a result, if the temperature is less than or equal to the predetermined value (T1<=300 °C.), it is determined that the overincrease of the temperature at the end of the heating roller 23 is prevented, and thus, the magnetic flux shields 29 are moved to the home position (Step S26). Then, Step S21 and later are repeated.

As described above, in the fourth embodiment, the contacting state of the fuser belt 22 with the heating roller 23 is detected, and the magnetic flux acting upon the end of the heating roller 23 is reduced in accordance with the detection result. With this, the fuser belt 22 contacting the heating roller 23 is moved in the width direction so that the overincrease of the temperature at the end of the heating roller 23 can be prevented from occurring even if the contact failure at the edge of the fuser belt 22 with the heating roller 23 occurs.

It should be noted that in the fourth embodiment, when the temperature of the end of the heating roller 23 becomes greater than a predetermined value, the magnetic flux at the end (where the contact failure occurs) of the heating roller 23 is reduced. On the contrary, when the temperature of the edge of the fuser belt 22 is below the predetermined value, the magnetic flux at the end (where the contact failure occurs) of the fuser belt 22 may be reduced. However, in this case, there is a need for control (for example, correction is made in accordance with a period in which the induction heating unit 24 is energized) to determine whether the temperature reduction of the fuser belt 22 is caused by the contact failure or a normal fusing step (for example, in the case where the fuser is just started, and thus the temperature of the heating roller or the fuser belt is still low). In this case, the effect similar to the effect of the fourth embodiment can be obtained.

In the embodiments described above, the temperature sensors 37*a* and 37*b* are used as the temperature detection units for indirectly detecting the contacting state of the edge of the fuser belt 22 in the width direction with the heating roller 23. On the contrary, a displacement detection unit such as an optical sensor, a piezoelectric sensor and the like may be provided at the edge of the fuser belt 22 in the width direction so as to detect the contacting state (lifting) of the fuser belt 22 with the heating roller 23 directly. In this case, the magnetic flux acting upon the end of the heating roller 23 is lowered in accordance with information on the contact failure directly detected by the displacement detection unit. Accordingly, the effect similar to the previously described embodiments can be obtained.

Further, the present invention is not limited to these embodiments, but variations and modifications may be made without departing from the scope of the present invention. The number, position, form, and the like of the components are not limited to the embodiments, but favorable number, position, form, and the like may be adopted upon working the embodiments.

The present application is based on Japanese Priority Application No. 2005-183623 filed on Jun. 23, 2005, with the Japanese Patent Office, the entire contents of which are hereby incorporated by reference.

What is claimed is:

1. A fuser, comprising:

a magnetic flux generation unit to generate a magnetic flux;

a heating member which is heated by an electromagnetic induction of the magnetic flux;

a fuser member to contact the heating member and heat a toner image so as to fuse the toner image onto a recording medium;

a detection unit configured to directly or indirectly detect whether an edge of the fuser member is in contact with the heating member in a width direction of the fuser member; and a magnetic flux adjusting member to reduce the magnetic flux acting upon an end in the width direction of the heating member in accordance with a detection result of said detection unit.

2. The fuser as claimed in claim 1, wherein in a case where said detection unit detects a contact failure between the heating member and the fuser member, said magnetic flux adjusting member reduces the magnetic flux at the end of the heating member.

3. The fuser as claimed in claim 1, wherein said detection unit is configured to detect a temperature of the edge of the fuser member and the end of the heating member, and wherein in a case where a difference between the temperature of the edge of the fuser member and the temperature of the end of the heating member detected by the temperature detection unit is greater than a predetermined value, said magnetic flux adjusting member reduces the magnetic flux at the end of the heating member.

4. The fuser as claimed in claim 3, wherein in a case where the temperature of the fuser member detected by the temperature detection unit becomes less than a predetermined value, said magnetic flux adjusting member reduces the magnetic flux at the end of the heating member.

5. The fuser as claimed in claim 3, wherein in a case where the temperature of the heating member detected by the temperature detection unit becomes greater than a predetermined value, said magnetic flux adjusting member reduces the magnetic flux at the end of the heating member.

6. The fuser as claimed in claim 3, wherein in a case where a temperature difference between the edges of the fuser member detected by the temperature detection unit is greater than a predetermined value, said magnetic flux adjusting member reduces the magnetic flux at one of said edges which one has a temperature that is lower than the temperature of the other one of said edges.

7. The fuser as claimed in claim 3, wherein in a case where a temperature difference between the ends of the heating member detected by the temperature detection unit is greater than a predetermined value, said magnetic flux adjusting member reduces the magnetic flux at one of said ends which one has a temperature that is lower than the temperature of the other one of said ends.

8. The fuser as claimed in claim 1, wherein said detection unit is configured to detect a displacement between the edge of the fuser member and an edge of the heating member, the displacement being detected when the fuser member fails to properly contact the heating member.

9. The fuser as claimed in claim 1, wherein said magnetic flux generation unit comprises:

a coil portion extending in the width direction of the heating member so as to oppose the heating member; and an internal core opposing the coil portion across the heating member, wherein said magnetic flux adjusting member is a magnetic flux shield provided between the coil portion and the internal core.

10. The fuser as claimed in claim 9, wherein said magnetic flux shield is configured to continuously or in a step progression adjust a range of an outer periphery of the internal core opposing the coil portion, said range being covered by the magnetic flux shield.

11. The fuser as claimed in claim 10, further comprising a driving unit to drive the magnetic flux shield to continuously or in the step progression adjust the range of the outer periphery of the internal core, said range being covered by the magnetic flux shield.

12. The fuser as claimed in claim 11, further comprising another detection unit to detect a width of the recording medium, wherein said driving unit drives the magnetic flux shield to adjust the range to be covered in accordance with the width of the recording medium detected by said another detection unit.

13. The fuser as claimed in claim 9, wherein said magnetic flux generation unit further comprises a core unit having a center core at a position where the magnetic flux generation unit does not oppose the heating member, said core unit opposing the coil portion, and wherein said magnetic flux shield covers an outer periphery of the internal core opposing the center core.

14. The fuser as claimed in claim 1, wherein said fuser member is a fuser belt, and said heating member is a heating roller which with an auxiliary fuser roller stretches the fuser belt.

15. The fuser as claimed in claim 14, wherein said fuser belt comprises a protrusion at each edge in the width direction on an inner circumferential surface contacting the heating roller, and wherein said heating roller comprises an engaging portion which contacts the protrusion at a time when the fuser belt is off to a side in the width direction.

16. The fuser as claimed in claim 15, wherein said engaging portion is provided at a flange which is press-fitted in each of the ends of the heating roller.

17. The fuser as claimed in claim 14, wherein said auxiliary fuser roller is configured to contact a pressure roller across the fuser belt, said pressure roller pressing the recording medium to be delivered.

18. An image forming device, comprising the fuser as claimed in claim 1.

* * * * *